United States Patent [19]

Linebrink et al.

[11] 3,946,551

[45] Mar. 30, 1976

[54] PUMPING AND METERING SYSTEM

[75] Inventors: Kail L. Linebrink, Bloomfield; Lawrence S. Smith, Simsbury, both of Conn.

[73] Assignee: United Technologies Corporation, Hartford, Conn.

[22] Filed: Jan. 17, 1974

[21] Appl. No.: 434,150

[52] U.S. Cl. ..... 60/39.28 R; 60/39.14; 417/203; 417/202; 417/322

[51] Int. Cl.[2] ..... F02C 9/08

[58] Field of Search..... 60/39.28 R; 417/202, 203, 417/205, 206, 322

[56] References Cited

UNITED STATES PATENTS

| | | | |
|---|---|---|---|
| 2,782,595 | 2/1957 | Pauly | 417/203 X |
| 3,056,259 | 10/1962 | Jubb | 417/202 X |
| 3,367,107 | 2/1968 | Richardson | 60/39.28 R |
| 3,406,670 | 10/1968 | Hines | 417/322 X |
| 3,433,016 | 3/1969 | Borel | 60/39.28 R |
| 3,547,557 | 12/1970 | Grennan | 417/205 X |
| 3,596,467 | 8/1971 | Avery | 60/39.28 R |
| 3,606,754 | 9/1971 | White | 60/39.28 R |
| 3,696,612 | 10/1972 | Bermann | 60/39.28 R |
| 3,699,774 | 10/1972 | Davis | 60/39.28 R |
| 3,784,329 | 1/1974 | Crawley | 60/39.28 R |
| 3,803,424 | 4/1974 | Smiley | 417/322 X |

*Primary Examiner*—Clarence R. Gordon
*Attorney, Agent, or Firm*—John D. Del Ponti

[57] ABSTRACT

This invention relates to an electromechanical pumping and fuel metering means interfacing an electronic fuel control adapted for small engines. A centrifugal engine driven pump and electrically driven pump are combined such that the electrically driven pump pressurizes the fuel at low crank up speeds and continuously meters fuel to the burner section and the centrifugal pump pressurizes the fuel at all other times, so as to utilize the centrifugal pump during its high efficiency regime and the electrically driven pump when the centrifugal pump is not at its high efficiency regime.

7 Claims, 2 Drawing Figures

PUMPING AND METERING SYSTEM

BACKGROUND OF THE INVENTION

This invention relates to fuel pressurizing and metering means for a small high speed turbine type of power plant and particularly to the electromechanical interface of an electronic fuel control suitable for missile or automotive applications.

As is well known in the art centrifugal gas turbine engine pumps have not heretofore been feasible because they require high cranking speeds to provide sufficient fuel system pressurization for starting the engine. It is also well known that where a centrifugal pump is directly driven by the engine, such a pressurization system employs a positive displacement pump for low engine cranking speed and requires a mechanical reduction drive. Additional attempts of hybrid pumping systems have employed a positive displacement pump for cranking in conjunction with a mechanical or hydraulic decoupler. The mechanical drive reduction necessitated by the positive displacement pump or the mechanical hydraulic coupling devices are not only expensive but they are also complex and heavy which add to the overall weight of the aircraft. Obviously, in aircraft applications any additional weight introduces a penalty to the system and hence, adversely affects the payload.

We have found that we can take advantage of the pressurization capabilities of the centrifugal pump by combining it with an electrically driven positive displacement pump for obtaining both starting and metering capabilities. The electric driven positive displacement pump speed becomes proportional to the desired fuel flow and thereby becoming the metering element. Motor driven pumps have not been conducive to system miniaturization in the past because the motor required two to three horsepower to deliver two gallons per minute at 800 or 900 pounds per square inch absolute. According to this invention the centrifugal pump is utilized to provide pressure thereby reducing the work required by the metering pump drive motor to a small fraction of the horsepower since the pressure load is reduced to essentially fuel line losses.

According to this invention the centrifugal pump is utilized in combination with either a piezoelectric driven metering pump or an electrical motor driven pump which may be of the vane type.

In both instances the metering becomes an integral part of the electronic control systems which meters fuel as a function of the output of the electronic control which serves to regulate fuel as a function of the demands of the engine requirement.

SUMMARY OF THE INVENTION

An object of this invention is to provide interfacing of the electronic fuel control with electromechanical means for pressurizing and metering fuel to engine.

A still further object of this invention is to provide for a small engine which may be adapted for missile or automotive applications, combined centrifugal and positive displacement pumps which serve as both pumping and metering means.

A still further object of this invention is to provide means interfacing the electronic control for delivering fuel to the engine at a required pressure which includes a centrifugal engine driven pump and an electric motor driven or a piezoelectric driven metering pump.

Other features and advantages will be apparent from the specification and claims and from the accompanying drawings which illustrate an embodiment of the invention.

DESCRIPTION OF THE PREFERRED EMBODIMENT

Figure 1:
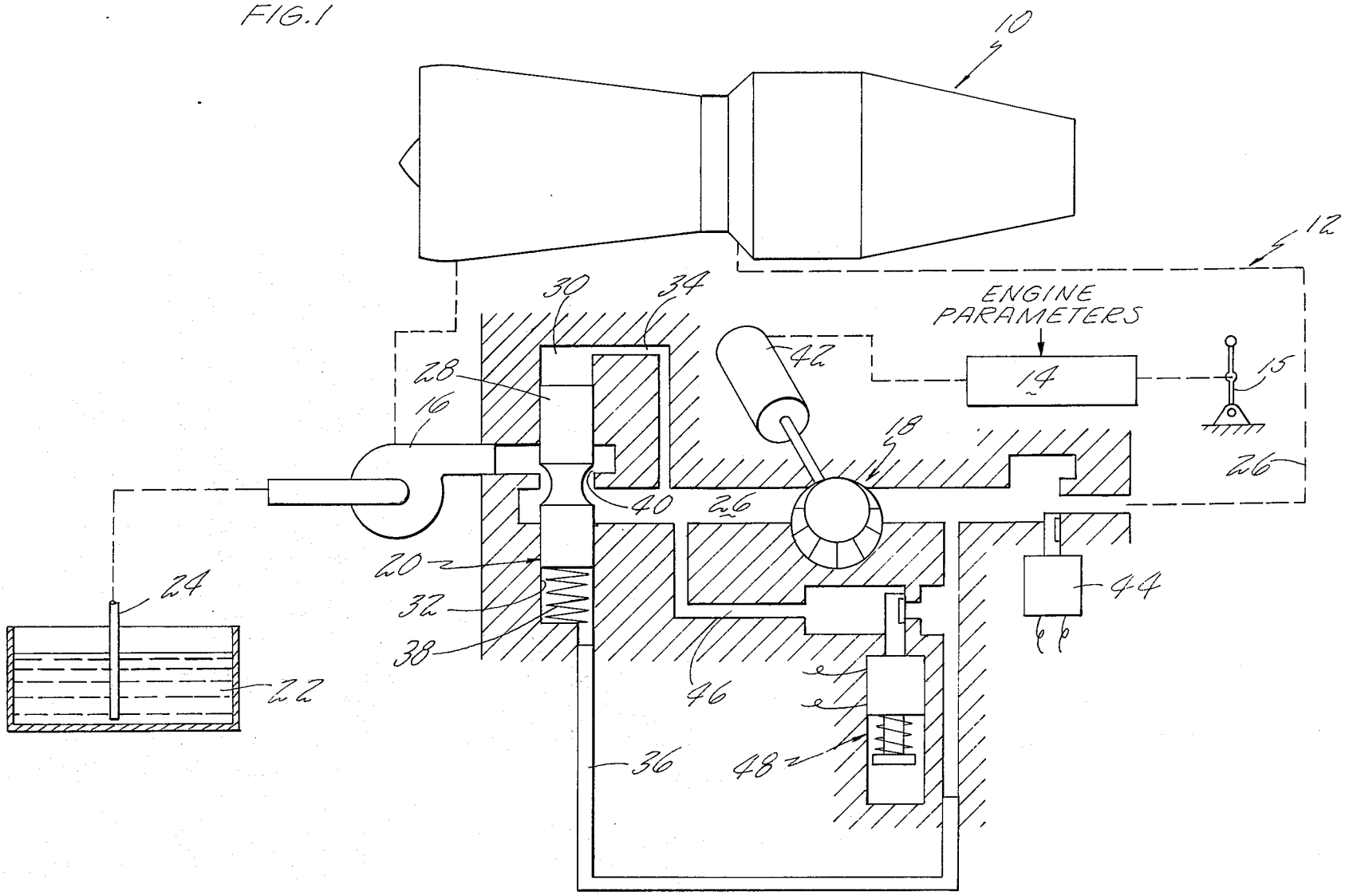
FIG. 1 is a schematic illustration of this invention.

Essentially this invention is concerned with the interface between the electronic control for a turbine type of power plant and the means for delivering fuel to the combustion section of said power plant. As can be seen by referring to FIG. 1 a suitable turbine type power plant generally illustrated by numeral 10 is supplied fuel by the schematically illustrated fuel control generally illustrated by numeral 12 to produce the amount of thrust or horsepower for its given application. It is to be understood that the power plant can be utilized in aircraft, missile, automotive, marine or industrial applications. As schematically illustrated an electronic computer illustrated in blank by reference numeral 14 serves to measure a plurality of engine operating parameters including the power lever 15 in order to obtain proper engine operating conditions and guard against the usual undesirable conditions, as surge, rich and/or lean blowout, over temperature, etc. Inasmuch as suitable electronic fuel controls are known in the art the detailed description thereof is omitted herefrom for the sake of clarity and simplicity. An example of a suitable electronic control is shown in U.S. Pat. No. 3,606,754 granted to Albert H. White on Sept. 21, 1973 entitled "Hybrid Fuel Control" to which reference should be made. This invention is primarily concerned with the interface between the electronic control and the hydromechanical elements required to meter the fuel into the burner section of the engine in response to the control. While this particular invention is basically suitable for a small engine in the 50,000 to 75,000 rpm or in a higher class which is particularly adapted for automobiles and missile applications it is not necessarily limited thereto.

The invention basically comprises an engine driven centrifugal pump 16, a suitable metering pump, which in this instance is an electrically driven vane type of pump generally illustrated by numeral 18, and pressure regulator 20. Fuel from reservoir 22, is delivered to the burner section (not shown) of the power plant 10 via line 24, centrifugal pump 16, pressure regulating valve 20, line 26, and metering pump 18.

Pressure regulating valve 20, which may take any suitable form serves to maintain the pressure drop across the vane pump 18 at a constant value. Thus, spool 28 having one face exposed in chamber 30 and the opposing face exposed in chamber 32 is balanced by the pressure upstream and downstream of vane pump 18 admitted thereto via lines 34 and 36 respectively. It is apparent that the size of spring 38, disposed in chamber 32 and urging spool 28 in an upward direction determines the value of the constant pressure drop across vane pump 18 and adjusts metering orifice 40 to maintain this value.

In accordance with the present invention the system is designed to permit the vane pump 18 to pressurize the fuel to the required value during engine start up until idle speed is reached. During starting, pressure regulating valve 28 will be saturated full open due to insufficient centrifugal pump delivery pressure and fuel flow is metered to the engine in proportion to the rotational speed of vane pump 18. As soon as idle is obtained and between idle and maximum speed the centrifugal pump will be at sufficient speed to cause it to pressurize the fuel and the pressure regulating valve will begin to close off so that the pressurization initially provided by vane pump 18 will become ineffectual. Hence speed of vane pump 18 will serve to meter the flow of fuel to the engine, bearing in mind that the speed of vane pump 18, driven by electric motor 42, is controlled by the electronic controller 14.

The solenoid operated shut-off valve 44 is, prior to starting, in the closed position and remains closed until the pressure of the fuel reaches a predetermined value, say 10 psig. Obviously, solenoid valve 44 preferably is operated by controller 14 as one of its normal functions.

In the event of a malfunction, such as an electrical power loss a bypass line 46 and solenoid valve 48 may be incorporated to assure that fuel flow is maintained at a minimum value. In this instance valve 48 would be de-energized and spring loaded open and fuel would be shunted around vane pump 18. The pressure regulating valve 20 would maintain a constant pressure drop across valve 48 and hence the flow therethrough would be dictated by the size of its opening.

Figure 2:
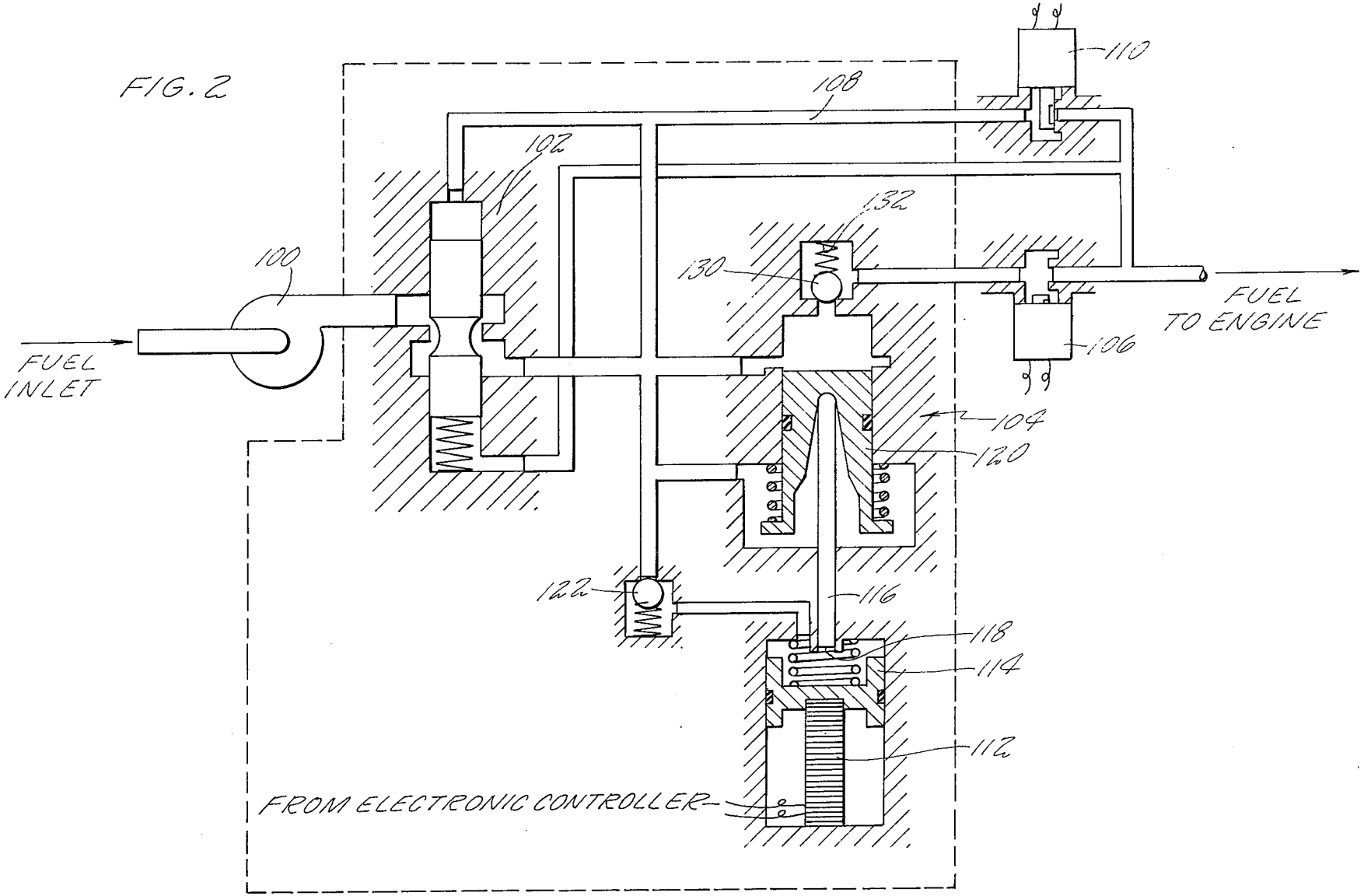
FIG. 2 is another schematic illustrating a second embodiment of this invention.

FIG. 2 exemplifies another embodiment utilizing this invention and is basically similar to the system shown in FIG. 1 but differs primarily therefrom by using a piezoelectric driven pump. As can be seen from FIG. 2, the mechanical interface includes centrifugal pump 100, pressure regulating valve 102, piezoelectric pump 104, solenoid shutoff valve 106, bypass line 108 and solenoid bypass valve 110, all functioning identically to what was described in the system described in FIG. 1.

The piezoelectric drive is a high-force, low-displacement device formed by stacking a plurality of piezoceramic discs 112 bearings against spring loaded piston 114. The piezoelectric material of the discs 112 may be those that exists in nature, as for example Quartz or Rochelle salts, or may be formulated from as for example barium titanate, lead zirconate titanate, etc. The force is derived by applying a strong electric field along one axis of the polycrystalline discs biasing the crystals to align their longest axis with the direction of the field. Since many crystals are involved, the alignment is statistically influenced and the strain-field response tends to be linear rather than by step function.

Barium titanate and lead zirconate titanate fabricated discs have demonstrated that normal unrestricted strains of 0.002 in./in. are developed with applied field strengths of 50 KV/in. The unrestricted strain is reduced according to Hookes's law in the case where the expansion is restricted. With a Young's Modulus of $5 \times 10^6$ psi a strain of 0.001 in./in. can be achieved against a compressive stress of 5000 psi.

The discs 112 are fabricated to sandwich the piezoceramic material with an electro conductive coating. When a dc voltage is applied across the disc, the material develops a strain in the direction of application of the electric field. Thus the stack of discs generate a high force intensity with a minute displacement.

This work may be converted into large-displacement, low-force motion by either mechanical or hydraulic amplifiers. In this embodiment the amplification is obtained hydraulically by plunger 116 having one end 118 exposed to fluid acted on by piston 114. Thus, movement generated by exciting the piezoelectric stack 112 displaces piston 114 which in turn drives plunger 116. The opposite end bears against the spring loaded pumping and metering element 120 for pumping and/or metering fuel in the same manner as was done by the vane pump described in connection with FIG. 1.

Check valve 122 keeps the fluid acting on plunger 118 at the proper level. Thus, it communicates with both the main metering passages and the bypass line 108 depending on which one is delivering fuel to the engine.

Thus, the positive displacement pumping action of the piezoelectric piston 120 provides starting flow and as in the case of FIG. 1, the engine driven centrifugal pump provides the required fuel pressurization between idle and maximum speed.

Regulating valve 102 and pressure available from the centrifugal pump 100 between idle and maximum speed are used to allow further electrical power reductions. This is accomplished by using the piezoelectric actuated piston 120 as a pulse-width-modulated metering valve between idle and maximum speeds. The pumping and metering action can be illustrated by assuming the metering piston pump relief valve 130 to be set by spring 132 at 10 psi and pressure regulating valve 102 at 50 psi. During starting, regulating valve 102 will be saturated full open due to insufficient centrifugal pump delivery pressure and fuel flow is metered to the engine in proportion to the cyclic rate of metering piston 120. At speeds between idle and maximum centrifugal pump 100 will have sufficient pressure to cause piston relief valve 130 to saturate full open when the piston inlet port is open. The inlet and outlet sizes, in conjunction with the pressure regulating valve, will enable the engine to receive maximum flow as long as the piezoelectric pump is not energized. If the pump is energized the flow will drop to zero, thus enabling flow to be modulated by varying the pulse width of a constant frequency pulse train. By operating at one to two hundred cycles per second, the engine and regulating valve will respond to the average flow defined by the pulse width (i.e., valve open 10 percent of cycle duration will result in average flow of 10 percent of maximum). Electrical power for the piezoelectric device would become dependent upon the maximum starting flow and pump and line losses since maximum flow will require no electrical power to the piezoelectric stack 112. It is estimated that with 100 pph maximum light up flow and 20 psi rise for the pump, 15 watts of electrical power would be required. Switching from cyclic rate modulation to pulse width modulation for flow would be accomplished by the electronic controller at a predetermined engine speed near idle.

It should be understood that the invention is not limited to the particular embodiments shown and described herein, but that various changes and modifications may be made without departing from the spirit or scope of this novel concept as defined by the following claims.

We claim:

1. A fuel metering system cooperating with an electronic fuel control adapted to monitor and select the fuel flow of a turbine type of power plant, the combination including a source of fuel, fuel connecting means interconnecting said source and said power plant, a power plant driven centrifugal pump in said fuel connecting means, an electrically driven displacement type of pump responding to said electronic control disposed in said fuel connecting means in series flow relationship to said centrifugal pump, said displacement type of pump pressurizing the fuel delivered by said centrifugal pump when the power plant is operating below a predetermined power plant operating parameter and continuously metering said fuel, and said centrifugal pump solely pressurizing said fuel when the power plant is operating above said predetermined power plant operating parameter.

2. A fuel metering system cooperating with an electronic fuel control adapted to monitor and select the fuel flow of a turbine type of power plant, the combination including a source of fuel, fuel connecting means interconnecting said source and said power plant, a power plant driven centrifugal pump, a piezoelectrically activated displacement type of pump disposed in series flow relationship to said centrifugal pump responding to said electronic control, both of said pumps being disposed in said fuel connecting means, said displacement type of pump pressurizing the fuel when the power plant is operating below a predetermined power plant operating parameter and metering said fuel above said predetermined power plant operating parameter, and said centrifugal pump solely pressurizing fuel when said displacement pump is in the metering condition of operation.

3. A fuel metering system as claimed in claim 2 including a pressure regulating valve for maintaining the pressure drop across said displacement type of pump at a constant value.

4. A fuel metering system as claimed in claim 3 including a bypass line for bypassing flow of fuel around said displacement pump and means to render said bypass line inoperative.

5. A fuel metering system as claimed in claim 4 including a solenoid activated shutoff valve disposed in said bypass line and means for actuating said solenoid to position said valve to an open position whereby the flow of fuel bypasses said positive displacement pump.

6. A fuel metering system as claimed in claim 2 wherein said piezoelectric motor actuates a hydraulic amplifier for imparting a large stroke from the small high force displacement of the piezoelectric motor.

7. In a gas turbine power plant having a source of fuel and means for delivering a predetermined amount of fuel to the power plant including an electronic fuel control monitoring the engine operating parameters to produce an output signal, said means including an engine driven centrifugal pump and an electrically driven positive displacement pump disposed in series flow relationship downstream of said centrifugal pump, pressure regulating means responsive to the pressure up and downstream of said positive displacement pump for maintaining the pressure drop thereacross at a constant value, means responsive to said output signal for driving said positive displacement pump whereby a) during start up said positive displacement pump both pressurizes and meters said fuel and said pressure regulating means is full open such that said centrifugal pump operates without imparting a pressure to said fuel, and b) upon reaching a predetermined power plant speed said positive displacement pump meters fuel in response to said output signal and said centrifugal pump pressurizes said fuel.

* * * * *